US005226637A

United States Patent [19]

Kitaura et al.

[11] Patent Number: 5,226,637

[45] Date of Patent: Jul. 13, 1993

[54] CLAMPING DEVICE

[75] Inventors: Ichiro Kitaura, Itami; Yoshio Aoyama, Nagoya, both of Japan

[73] Assignee: Aioi Seiki, Inc., Hyogo, Japan

[21] Appl. No.: 857,333

[22] Filed: Mar. 25, 1992

[30] Foreign Application Priority Data

Mar. 26, 1991 [JP] Japan ..... 3-026700[U]

[51] Int. Cl.[5] ..... B25B 5/04

[52] U.S. Cl. ..... 269/234

[58] Field of Search ..... 269/101, 136, 138, 157, 269/160, 190, 217, 234; 254/104

[56] References Cited

U.S. PATENT DOCUMENTS

| | | | |
|---|---|---|---|
| 4,208,045 | 6/1980 | Rowe et al. | 269/234 |
| 4,643,411 | 2/1987 | Izumi | 269/138 |
| 4,867,428 | 9/1989 | Fricker | 269/138 |
| 4,901,991 | 2/1990 | Bonkowski | 269/234 |
| 5,056,766 | 10/1991 | Engibarov | 269/138 |

FOREIGN PATENT DOCUMENTS

| | | | |
|---|---|---|---|
| 614954 | 12/1948 | United Kingdom | 269/138 |

*Primary Examiner*—Robert C. Watson

*Attorney, Agent, or Firm*—Evenson, McKeown, Edwards & Lenahan

[57] ABSTRACT

A clamping device for clamping a work piece to be machined by a machine tool on a base surface of a table of the machine tool or a work pallet for fixing a work piece, comprises at least a clamp main body, a reaction support provided at the rear portion of the clamp main body, an input member disposed in front of the reaction support on the clamp main body with a gap therebetween, an output member arranged in front of the input member and having an output portion for clamping the work piece at the front end, a guide mechanism for slidably guiding the output member in a longitudinal direction directed back and forth, a driving mechanism for driving the input member toward the clamp main body, and a wedge type converting mechanism for converting a driving force supplied to the input member from the driving mechanism into a clamping force for driving the output member. During clamping drive or operation, the output member does not move vertically, thereby the work piece is free from damage and the machining accuracy is improved.

16 Claims, 22 Drawing Sheets

CLAMPING DEVICE

BACKGROUND OF THE INVENTION

The present invention relates to a clamping device suitable for clamping a work piece to be machined.

In order that the work piece is machined by a machine tool, it is necessary either to fix the work piece on the table of the machine tool in a precise and firm manner, or to mix the work piece on a work pallet in a precise and firm manner before the work pallet is secured to the machine tool table or the pallet. Various types of such clamping devices suitable for fixing work pieces to be machined have been proposed and put to actual use.

For example, a clamping device shown in FIG. 34 is at present in wide use, which clamping device 101 is placed on the base surface of the table or pallet so as to clamp a work piece WK in conjunction with an reaction receiving device 102. The clamping device 101 includes a clamp main body 103, clamp member 104 (input/output member), and a leg member 106 inserted in a T-shaped groove 105 formed on a base surface 100.

The clamp main body 103 has a reaction support 107 provided in the rear end portion thereof, and having an inclined face 108 on its front end. The clamp member 104 has a rear end portion including a rear end face 109 abutting the inclined face 108. The clamp main body 103 is fastened by means of a bolt 110 and leg member 106, and the clamp member 104 is arranged such that it may be driven downward by a clamp bolt 112 inserted from above into a bolt hole 111 of the clamp member 104. The clamp member 104 has an output portion 113 formed in its front end portion, and is biased upwardly by a spring 114.

The reaction receiving device 102 includes a main body block 115, a leg member 116, and two bolts, 117. The main body block 115 is fastened on the surface 100 by threadedly connecting two bolts 117 with the leg member 116.

As illustrated, before setting of the work piece WK in position, the bolt 112 is loosened to the extent that the clamp member 110 may be raised to a certain level. The work piece WK is then placed in position. Next, when the bolt 112 is fastened, the rear end face 109 of the clamp member 104 is guided by the inclined face 108 to allow the clamp member 104 to travel in a forward direction with the result that the work piece WK can be rigidly clamped between the output portion 113 of the clamp member 104 and a reaction output portion 118 of the main body block 115. In the alternative, the inclined face 108 may have a dovetail groove, and the rear end face 109 of the rear end of the clamp member 104 may be provided with a corresponding engaging portion for engaging with the dovetail groove.

Recent machine tools have been improved remarkably in their performance, and their machining accuracy has considerably improved. However, in conventional clamping devices, the arrangement is essentially such that the clamp member is advanced for clamping as it is lowered by fastening a bolt. Therefore, it is difficult to move the clamp member only forward and backward, and it is difficult to restrict assuredly the vertical movement of the clamp member. As, there exists a gap between the clamp member and the clamp main body which permits the downward movement of the clamp member, the bolt hole is of an elongated type, and an upward-directed component is included in a reaction force on the clamp member from the inclined face, when work piece is subjected to a strong cutting force, the clamp member will repeat a minute up-and-down movement so that the work piece is liable to float off the clamp main body, thus causing an error in the machining accuracy.

In addition, as another disadvantage, because the clamp member moves downward when clamping through the tightening of the bolt, scratching damages due to the output portion are caused on the surface of the work piece, and therefore clamping of the finished part of the work piece is not desirable. And, since the output portion of the clamp member is formed integral with the clamp member, the output portion cannot be exchanged for another one to fit to the configuration of a work piece. The aforementioned disadvantages cause various inconveniences to practical use.

SUMMARY OF THE INVENTION

The object of the present invention is to provide a clamping device in which the clamp member is composed of two separate input and output members so that the output member will not move vertically.

The clamping device for clamping a work piece in accordance with the present invention comprises a clamp main body, a reaction support provided at the rear portion of the clamp main body, an input member arranged on the clamp main body in front of the reaction support with a gap between the input member and the clamp main body and placed in contact with the front end face of the reaction support, an output member arranged on the clamp main body in front of the input member and having a main portion in contact with the front end of the input member, the output member including at its front end portion an output portion for pressing the work piece forward, a guide mechanism provided in the clamp main body and the output member for guiding the output member movably only in a longitudinal direction directed back and forth, a driving mechanism for driving the input member toward the clamp main body, and a wedge type converting mechanism for converting a driving force supplied to the input member from the driving mechanism into a clamping force for driving the output member forward.

DETAILED DESCRIPTION OF THE PREFERRED EMBODIMENT

Figure 1:
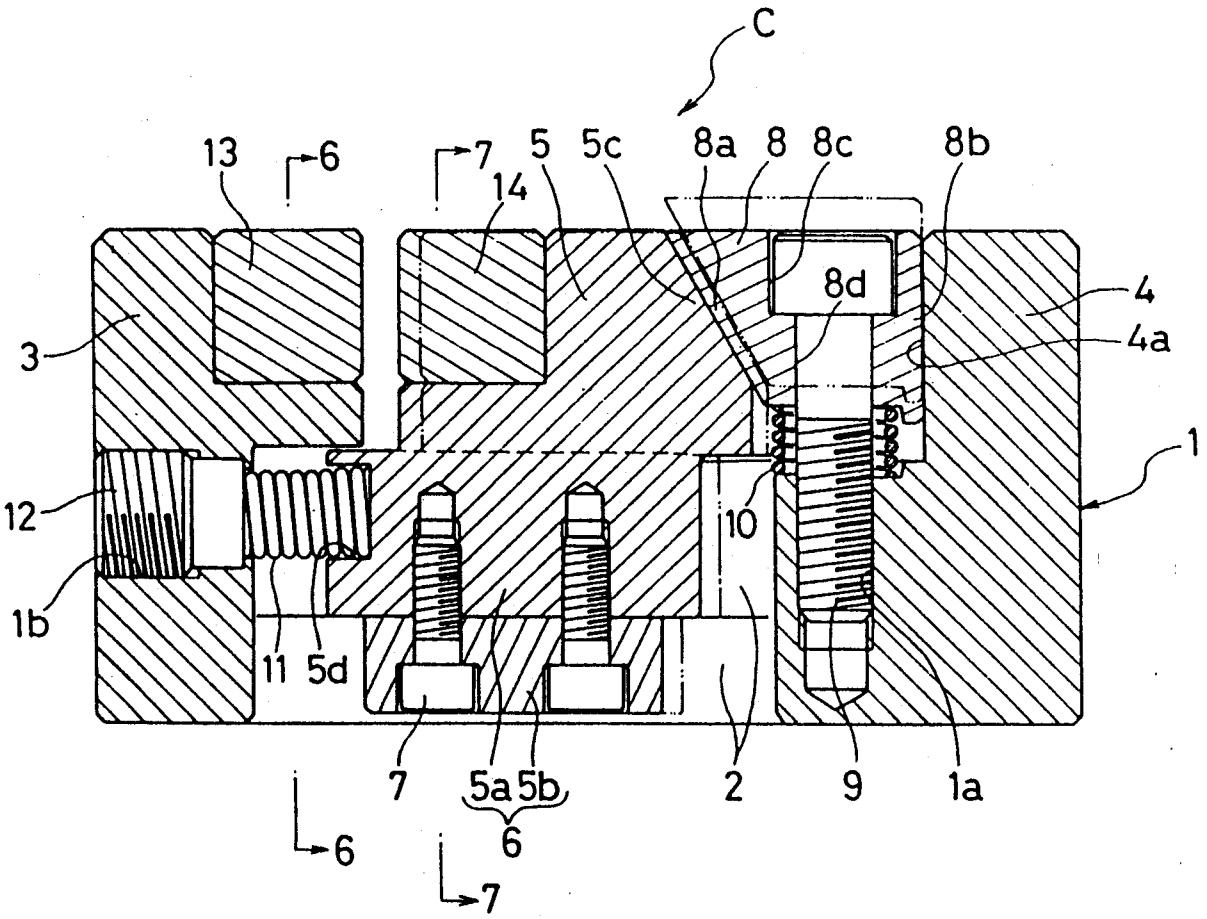
FIG. 1 is a vertically cross sectional side view of a clamping device of a first embodiment.

Now, embodiments of the present invention will be described in detail with reference to the drawings.

First Embodiment See FIGS. 1-7

A clamping device C in accordance with the present embodiment is intended to clamp work pieces to be machined or tools by a machine tool. The clamping device C has an elongated clamp main body 1 in a longitudinal direction directed back and forth, and a first reaction support 3 and a second reaction support 4 provided at front and rear ends of the clamp main body C, respectively. Since the clamp body 1 is fixed detachably on the table or pallet of a machine tool, or on the top or side face of a work pallet for fixing a work piece to be machined by the machine tool, there are provided vertical holes 1*c* formed extending through the first and second reaction supports 3 and 4 at lateral both opposite ends, and the clamp main body 1 is fastened on a base surface of the table or pallet by means of bolts (not shown) received in these bolt holes 1*c*.

Next, description will be made of a guide mechanism.

The clamp main body 1 has a T-shaped groove 2 formed between the first and second reaction supports 3 and 4 in the laterally central part of the clamp main body 1, the T-shaped groove 2 having an inverted T-like configuration and an open bottom. In the clamp main body 1, there are arranged an output member 5 and an input member 8 between the first and second reaction supports 3 and 4. A leg portion 6 of the output member 5 is constituted with an upright wall 5*a* forming a lower portion of the output member 5 and a leg element 5*b* fastened by a bolt 7 on the lower end of the upright wall 5*a*. The leg portion 6 of the output member 5 is engaged in the T-shaped groove 2 so that the former can slide back and forth, and the output member 5 is movable for a predetermined distance in forward and backward directions only through the engagement between the leg portion 6 and T-shaped groove 2, but not in a vertical direction.

Next, description will follow of an wedge type converting mechanism.

An input portion 8*a* formed at the front end of the input member 8 and a passive portion 5*c* formed at the rear end of the output member 5 are inclined upward toward the front at an angle of about 45°, the both portions 8*a*, 5*c* being in contact with each other on the faces thereof. The input member 8 has a rear end face 8*b* formed vertically at the rear end and the second reaction support 4 has a vertically formed front end face 4*a*, the both members being in contact with each other on the faces thereof.

Next, description will be made of a driving mechanism.

The input member 8 is provided with an upright hole 8*c* for receiving head of a clamp bolt 9 and a through bolt hole 8*d* extending downwardly from this upright hole 8*c*. The clamp bolt 9 is inserted from above into the upright hole 8*c* and bolt hole 8*d*, with the head of the clamp bolt 9 resting on the bottom of the upright hole 8*c*. The clamp bolt 9 has a leg fitted in a threaded hole 1*a*. A compression spring 10 is mounted around the clamp bolt 9 between the clamp main body 1 and input member 8 which is biased by the compression spring 10 in an upward direction. Thus, loosening of the clamp bolt 9 may ensure that the input member 8 is movable upward.

Next, description will be made of other structures.

The upright wall 5*a* of the input member 5 has a spring receiving hole 5*d* formed at the front end thereof, and the clamp main body 1 has a screw hole 1*b* formed in front of the sprig receiving hole 5*d*. A plug 12 is threadedly fitted in the screw hole 1*b*, also having a spring receiving hole (not shown) formed in the rear portion thereof, and a compression spring 11 is positioned between this spring receiving hole and spring receiving hole 5*d* so that the output member 5 is biased by the compression spring 11 in a backward direction, i.e. a direction in which clamping may be released. Therefore, if the clamp bolt 9 is loosened, the output portion 8*a* and passive portion 5*c* may be maintained in contact with each other.

The first reaction support 3 has a reaction output portion 13 fastened detachably to the clamp main body 1 by means of a pair of bolts 13*a*, while the output member 5 has an output portion 14 fastened detachably thereto by a pair of bolts 14*a*.

The T-shaped groove 2 is formed extending near to a bolt hole la so as to enable the input member 8 to move upward due to the loosening of the clamp bolt 9 to bring the output member 5 into the fully retracted position. To avoid any interference of the front end of the output member 5 with the clamp main body 1 in the event of the front end of the output portion 14 of the output member 5 being brought in contact with the rear end of the reaction output portion 13, the T-shaped groove 2 is extended as far as the lower side of the reaction output portion 13.

Figure 2:
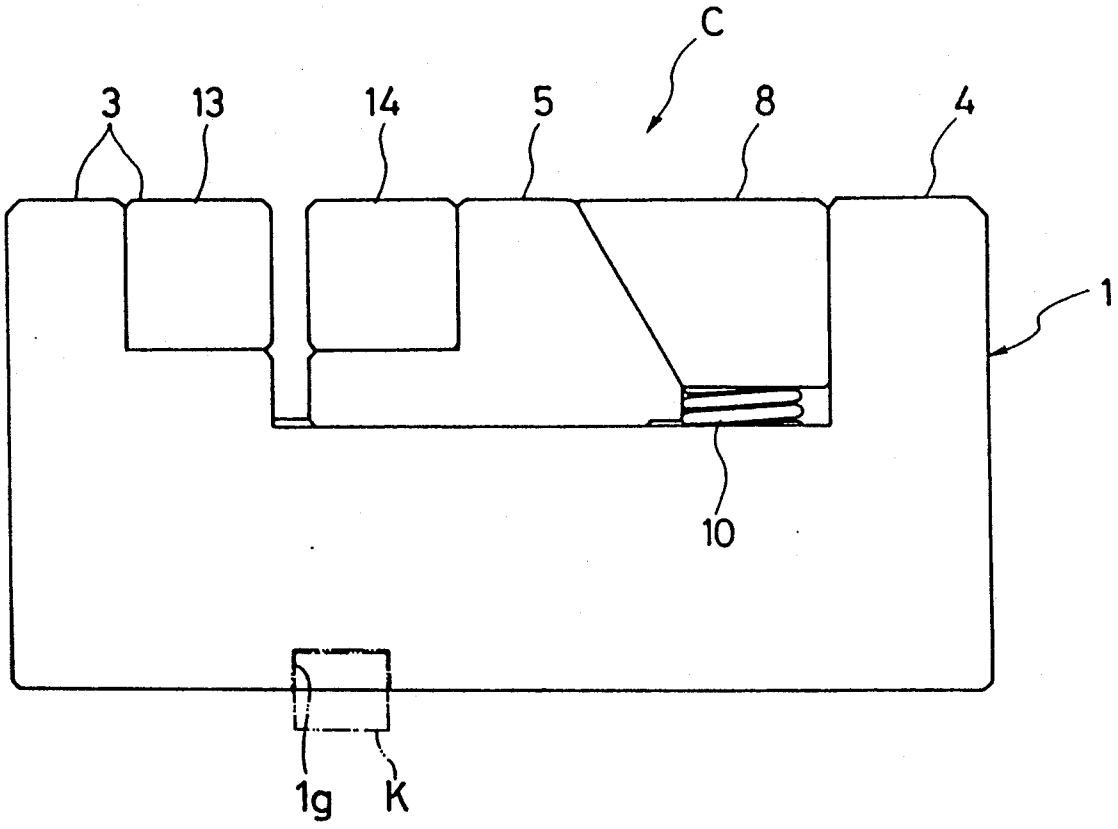
FIG. 2 is a side view of the clamping device of FIG. 1.
Figure 3:
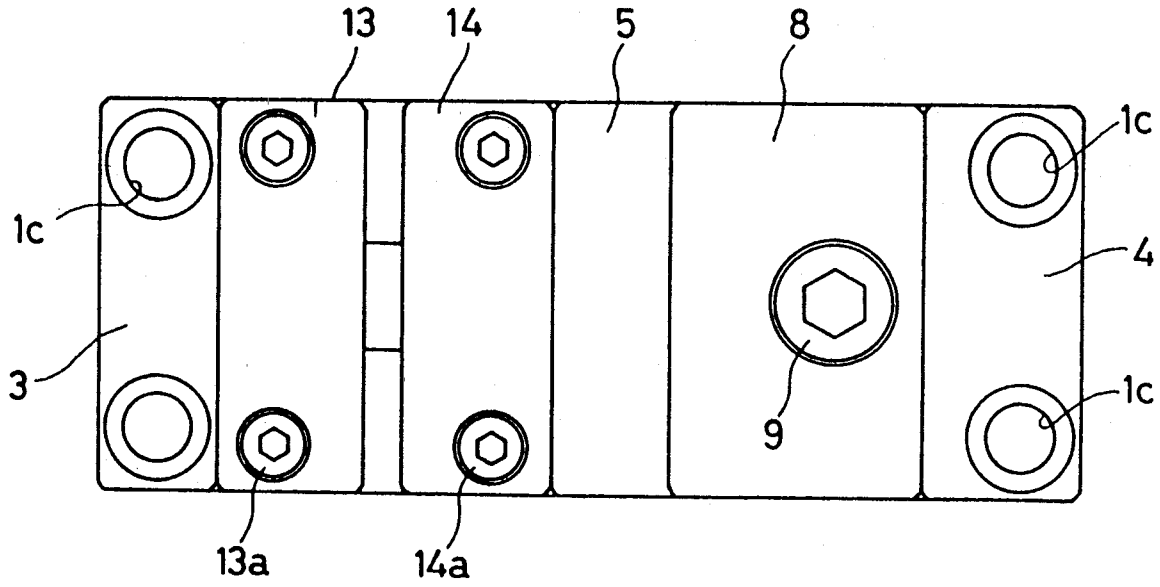
FIG. 3 is a plan view of the clamping device of FIG. 1.
Figure 4:
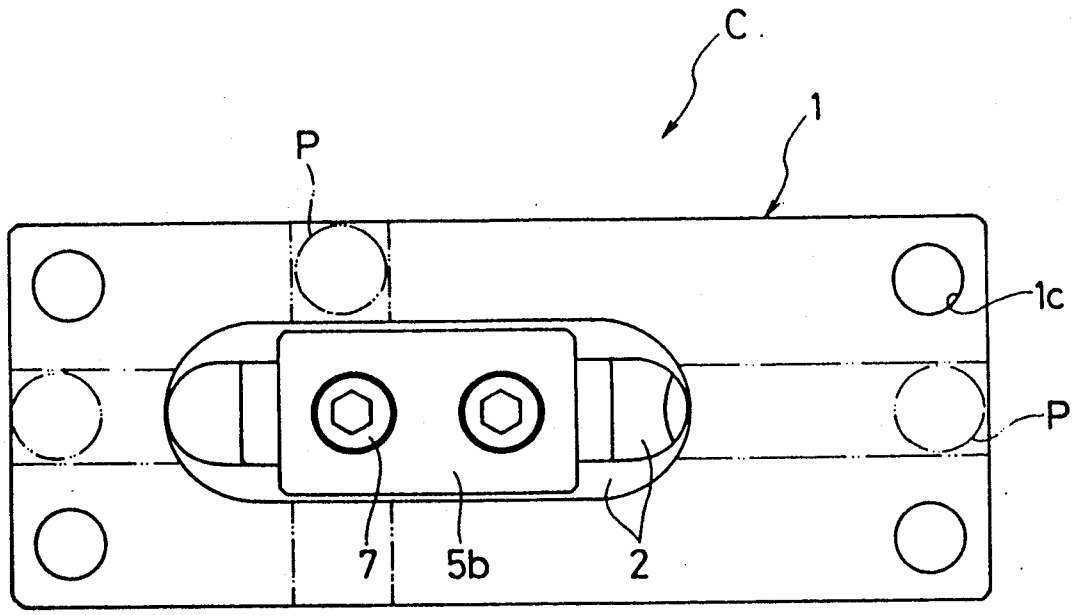
FIG. 4 is a bottom view of the clamping device of FIG. 1.
Figure 5:
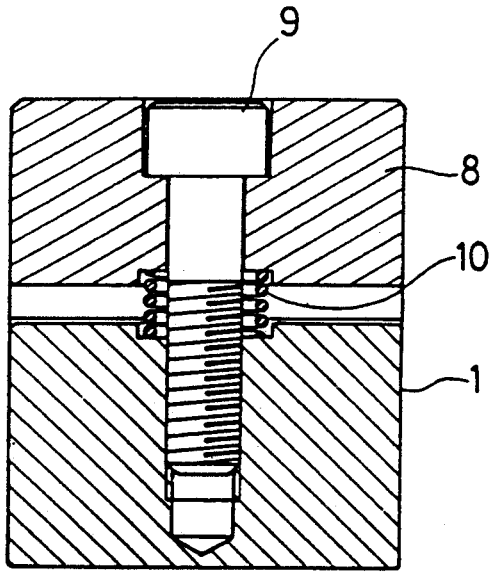
FIG. 5 is a cross sectional view taken along a line 5—5 in FIG. 1.
Figure 6:
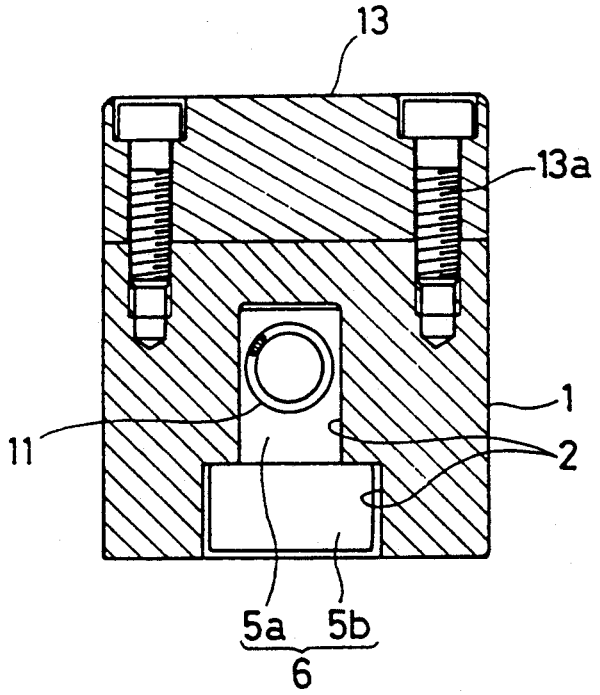
FIG. 6 is a cross sectional view taken along a line 6—6 in FIG. 1.

For the purpose of fixing the main clamp body 1 on the base surface of the table or pallet, a fixing leg portion in the form of an inverted T which is adapted to engage in the T-shaped groove (not shown) may be formed on the clamp main body 1 on the lower side. As illustrated by FIGS. 2 and 4, for accurately placing the clamping device C in position, a cross-recessed key groove 1*g* may be formed on the bottom face of the clamp main body 1 so that the positioning can be made by way of a key K on the base surface, or by way of a plurality of pins P on the base surface and the key groove 1*g*.

Next, description will be made of the operation of the clamping device C.

When clamping the work piece W to be machined, for example, the clamp bolt 9 is loosened to displace the input member 8 as shown by a chain line, and then, the work piece W is put in position between the reaction output portion 13 and the output portion 14. Then, when the input member 8 is urged to go downward by tightening the bolt 9, the passive portion 5*c* is pushed forward by the input portion 8*a*, followed by the output member 5 being driven forward. As a result, the work piece W is clamped or fastened between the reaction output portion 13 and the output portion 14. The output member 5 is only movable back and forth due to the engagement of the leg portion 6 and T-shaped groove 2, but not in a vertical direction, whereby the work piece W can be clamped precisely and securely. Such no movement of the output member 5 in a downward direction during clamping may render the work piece W free from any damage caused by the output portion 14.

As aforementioned, the output member 5 can be moved only in forward and backward directions, but not in a vertical direction. As the output member 5 is urged downward by the downward component of a force from the input portion 8*a* of the input member 8 to act on the passive portion 5*c* of the output member 5, the same may not be put in a vertical motion even if a strong external force acts on the work piece W, thereby to ensure that the work piece W can be maintained in a clamped position. Additionally, the detachable fixation of the reaction output 13 and output portion 14 in position makes it possible to apply the reaction output portion 13 and output portion 14 as held in a fixed state to any configuration of the work piece W. This enables adaptation of the instant device to clamping of work piece W of varied shapes.

Figure 8:
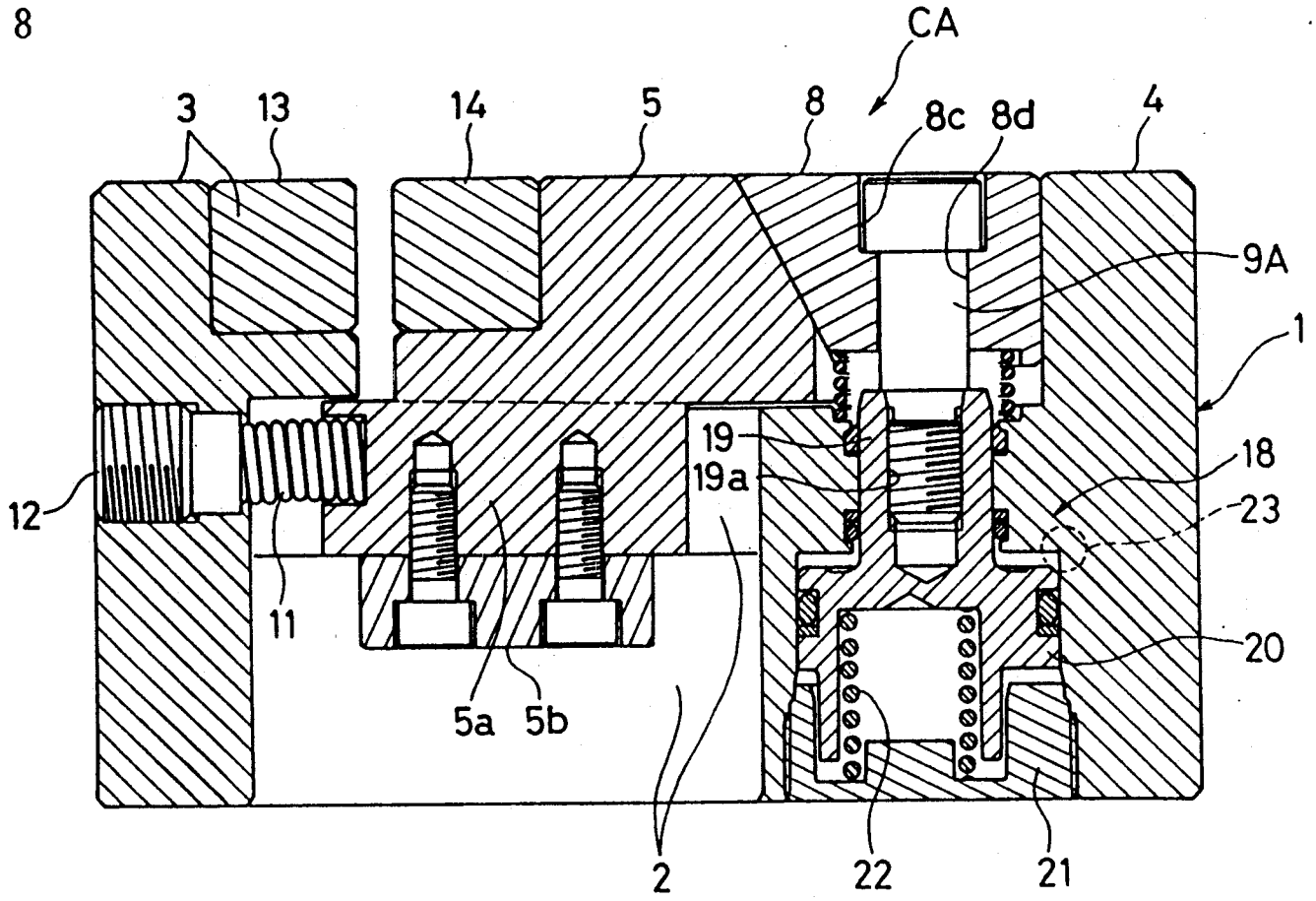
FIG. 8 is a vertically cross sectional view of a clamping deice of a second embodiment.
Figure 9:
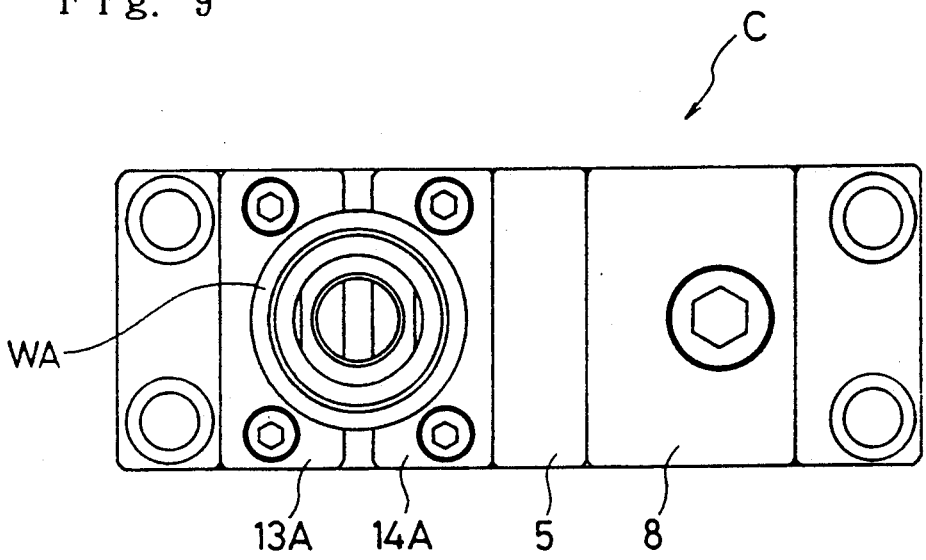
FIG. 9 is a plan view of the clamping device provided with modifications of a reaction output portion and output portion.
Figure 10:
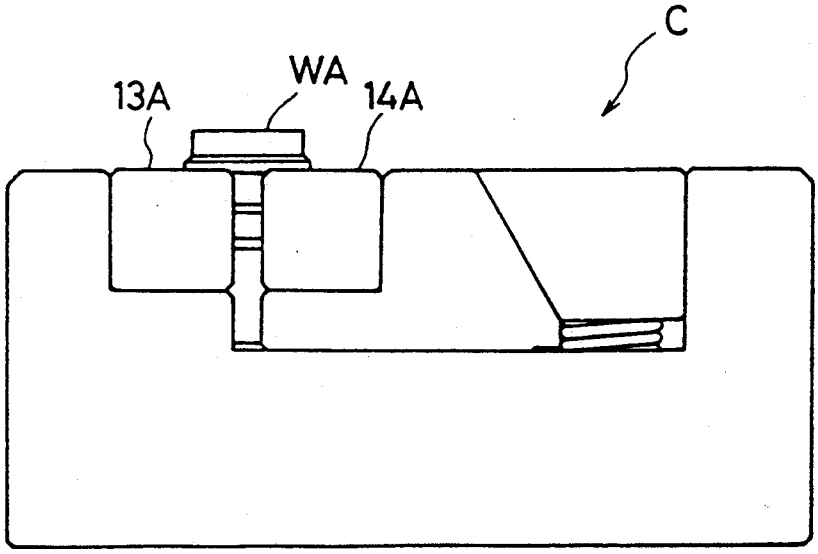
FIG. 10 is a side view of the clamping device of FIG. 9.
Figure 11:
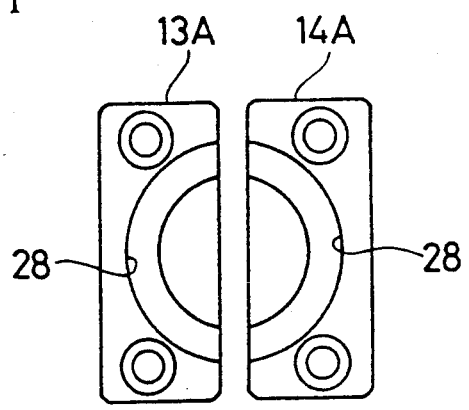
FIG. 11 is a plan view of the reaction output portion and output portion of the clamping device of FIG. 9.
Figure 12:
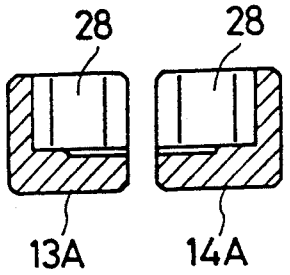
FIG. 12 is a vertically cross sectional view of the reaction output portion and output portion of the clamping device of FIG. 9.
Figure 13:
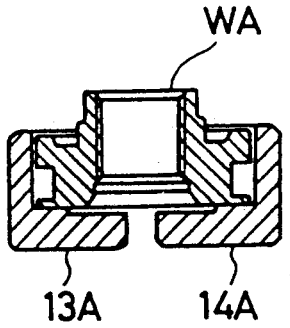
FIG. 13 is a vertically cross sectional view of the reaction output portion and output portion of the clamping device of FIG. 9 and a work piece.
Figure 14:
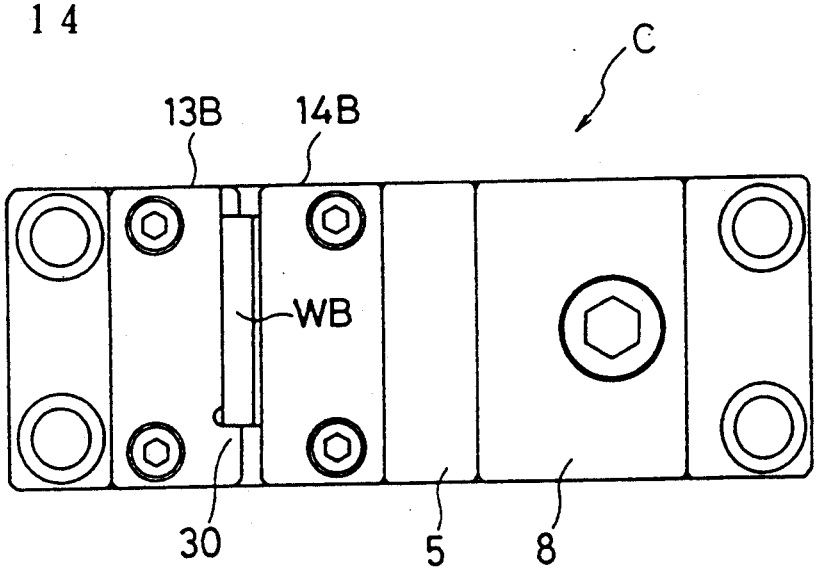
FIG. 14 is a plan view of the clamping device provided with modifications of the reaction output portion and output portion.
Figure 15:
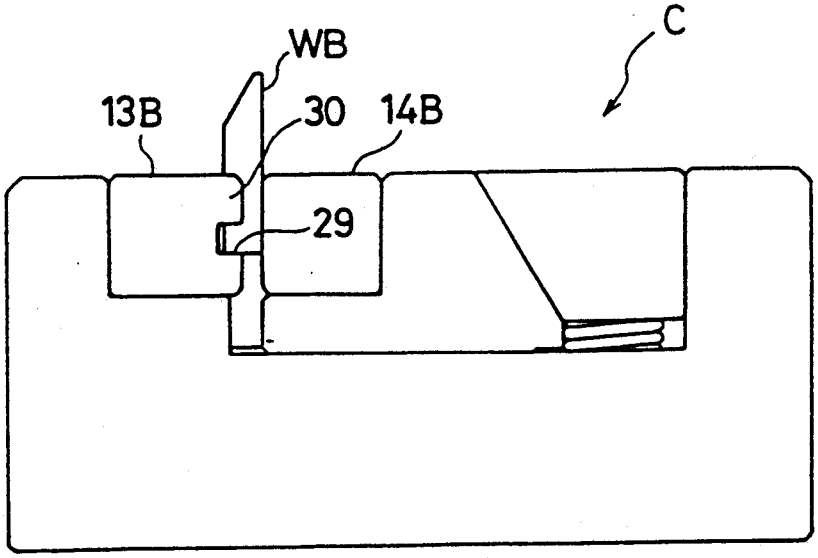
FIG. 15 is a side view of the clamping device of FIG. 14.
Figure 16:
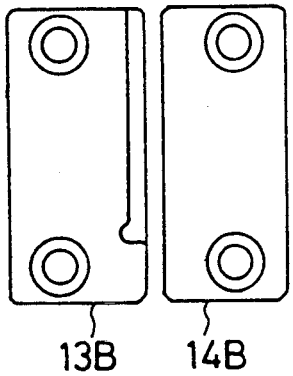
FIG. 16 is a plan view of the reaction output portion and output portion of the clamping device of FIG. 14.
Figure 17:
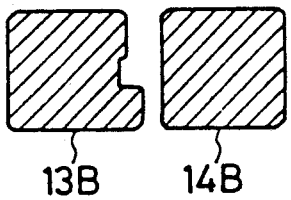
FIG. 17 is a vertically cross sectional view of the reaction output portion and output portion of the clamping device of FIG. 14.
Figure 18:
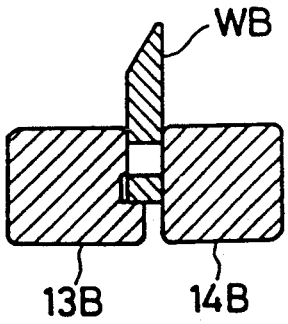
FIG. 18 is a vertically cross sectional view of the reaction output portion and output portion of the clamping device of FIG. 14.
Figure 19:
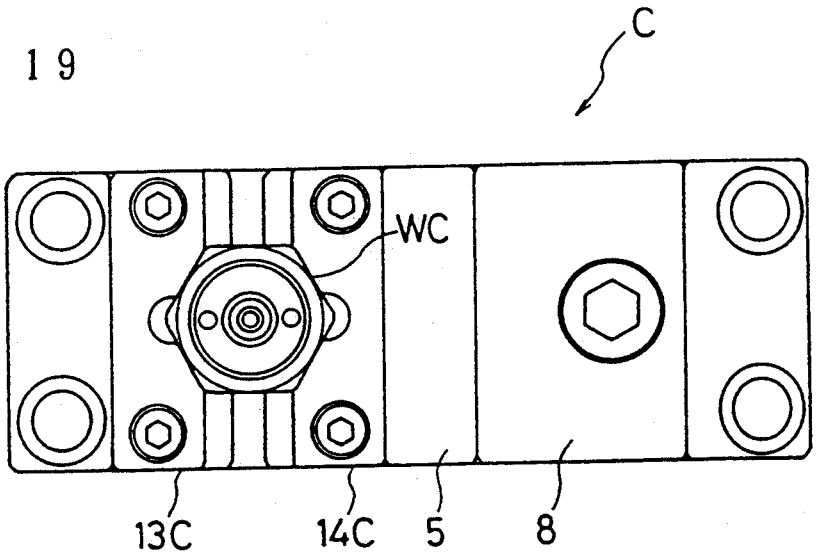
FIG. 19 is a plan view of the clamping device provided with modifications of the reaction output portion and output portion.
Figure 20:
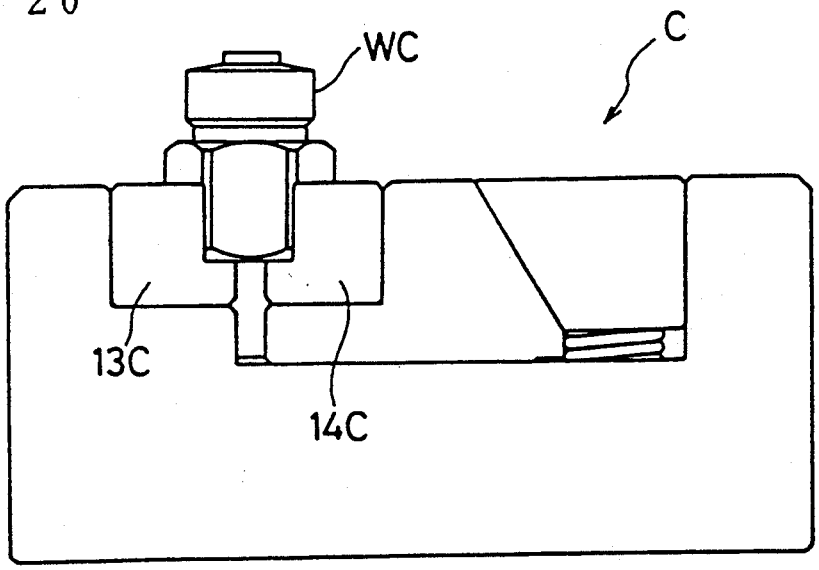
FIG. 20 is a side view of the clamping device of FIG. 19.
Figure 21:
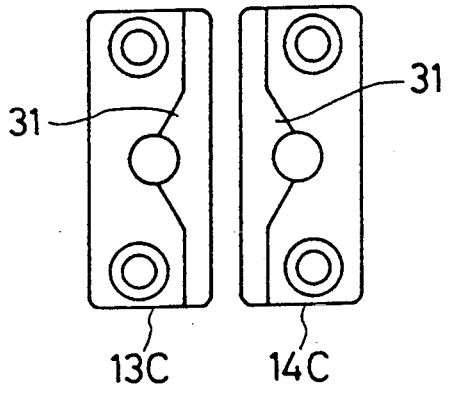
FIG. 21 is a plan view of the reaction output portion and output portion of the clamping device of FIG. 19.
Figure 22:
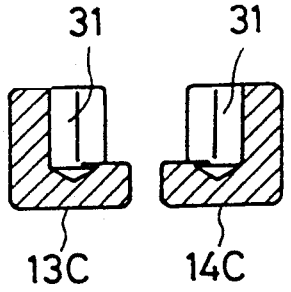
FIG. 22 is a vertically cross sectional view of the reaction output portion and output portion of the clamping device of FIG. 19.
Figure 23:
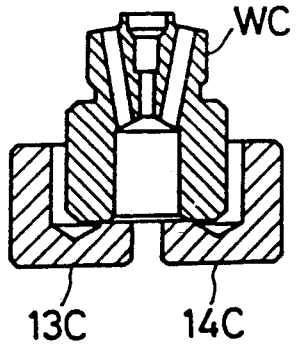
FIG. 23 is a vertically cross sectional view of the reaction output portion and output portion of the clamping device of FIG. and a work piece.

Second Embodiment See FIG. 8.

A clamping device CA in accordance with the present embodiment has a hydraulic cylinder 18 built in the clamp main body 1 as a driving mechanism for driving the input member 8 downward. Elements which are identical to corresponding elements of the first embodiment are given the same numerals. Descriptions of those elements are omitted. FIG. 8 shows that the single-acting hydraulic cylinder 18 is mounted in an upright position within the clamp main body 1 in the place below the input member 8. The hydraulic cylinder 18 has a piston rod 19 extending through a hole of the clamp body 1 vertically and upwardly. A bolt 9A is inserted from above into the vertical hole 8*c* and the bolt hole 8*d* of the input member 8 with a leg portion of the bolt 9. A threadedly fitted in a bolt hole 19*a* of the piston rod 19. A cylinder bore hole has a bottom end blocked by a plug 21, and a compression spring 22 is disposed between the piston 20 and the plug 22. There is provided an oil line 23 for introducing oil pressure to a working oil chamber 18*a* in the clamp main body 1, the oil line 23 being connected with an oil pressure source at the side of the clamp main body 1, the top face of the second reaction support 4, or the rear end of the clamp main body 1. With this clamping device CA, the input member 8 is driven downward for clamping operation by the hydraulic cylinder 18 and the bolt 9A. The clamping device CA is the same as the foregoing clamping device C in other operations.

Third Embodiment See FIGS. 9 to 23.

The present embodiment relates to various modifications of the reaction output portion 13 and the output portion 14 of the clamping devices C or CA, and elements in this embodiment are the same as those in the first embodiment except for the reaction output portion 13 and output portion 14, and so identical elements will be given the same numerals with a further description thereof being omitted.

A reaction output portion 13A and an output portion 14A as shown in FIGS. 9 to 13 are formed with work piece holding portions 28 having semicircular bottoms adaptable to a circular configuration of a work piece WA for clamping such a circular work piece WA.

Referring to FIGS. 14 to 18, for the purpose of clamping a plate-like work piece WB, an output portion 14B has a front end formed in a vertical plane, while a reaction output portion 13B is formed with a step 29 for receiving the lower end of the work piece WB and a stopper 30 for receiving the righthand end of the work piece WB.

A reaction output portion 13C and an output portion 14C as shown in FIGS. 19 to 23 are formed with work piece holding portions 31 cut at an angle of 120 degree for clamping a hexagonal work piece WC, and having bottoms.

The above-described are only a few examples, and it is to be understood that the reaction output portion and output may be used having proper work piece holding portions suitable to the configuration of various work pieces.

Figure 24:
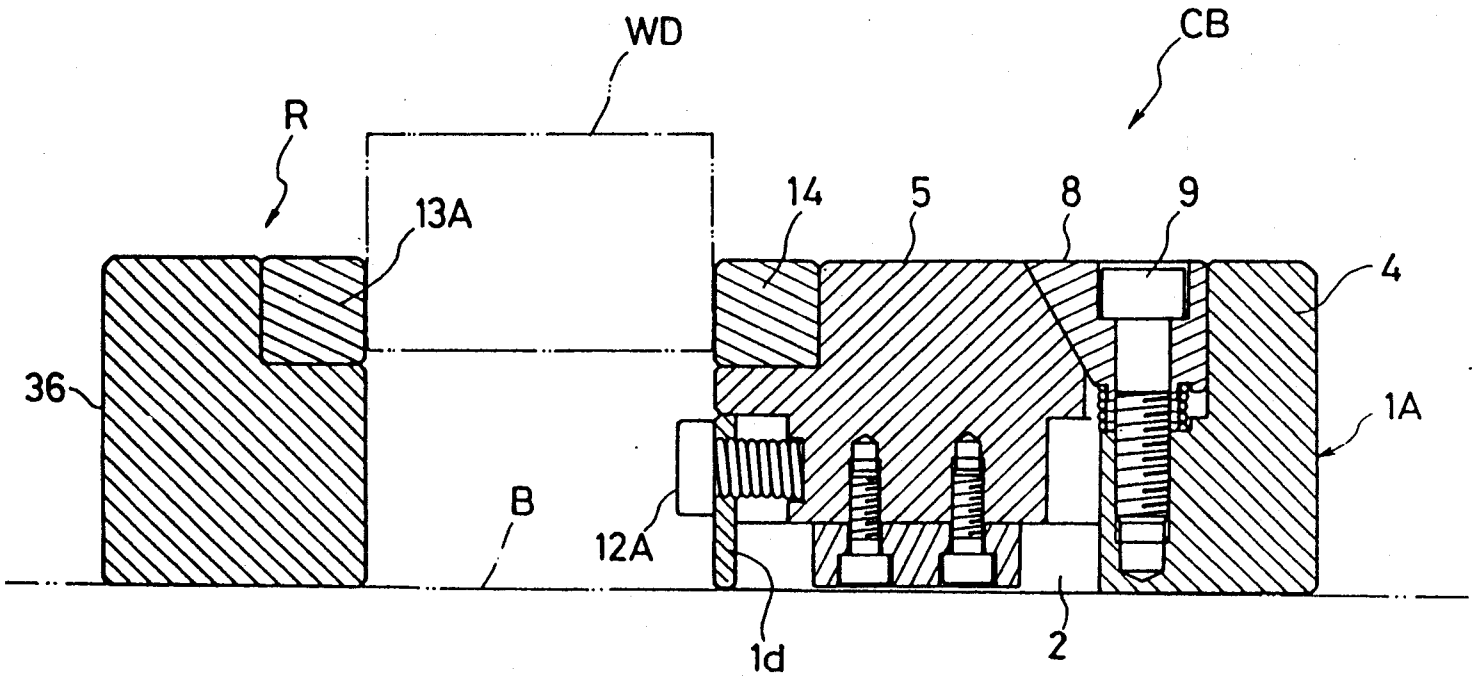
FIG. 24 is a vertically cross sectional view of a clamping device and a reaction receiving device of a fourth embodiment.

Fourth Embodiment See FIG. 24

A reaction receiving device R is arranged in front of a clamping device CB on the base surface of the table, pallet or work pallet. The reaction receiving device R is spaced at the length of a work piece WD from the clamping device CB. The clamping device CB is designed to clamp a relatively large work piece WD in cooperation with the reaction receiving device R. Since the space between the clamping device CB nd the reaction force receiving device R may be changed adequately as needed, thereby clamping of work pieces WD of various sizes can be achieved. The elements same as those used in the clamp device C of the first embodiment will be given the same numerals with a further description thereof being omitted, and only different structures will be explained.

The first reaction support 3 formed on the front end of the clamp main body 1A and its lower part are separated from the clamp main body 1A to serve as the reaction force receiving device R, and the clamp main body 1A has a wall **1*d* formed in the front end for blocking the front end of the T-shaped groove 2, and a plug 12A is secured to the wall 1*d*. The T-shaped groove 2 extends from the front portion to the longitudinal center portion of the clamp main body 1A**.

The reaction force receiving device R has a block member 36 and a reaction output portion 13A secured detachably to the upper rear end thereof. The block member 36 is fixed on the base surface B by means of two or four vertical fixing bolts so that the work piece WD may be clamped between the output portion 14 and reaction output portion 13A of the clamping device CB. The clamping device CB operates in the same manner as the clamping device C does in the exception of clamping the work piece WD between the output portion 14 and the reaction output portion 13A.

Figure 25:
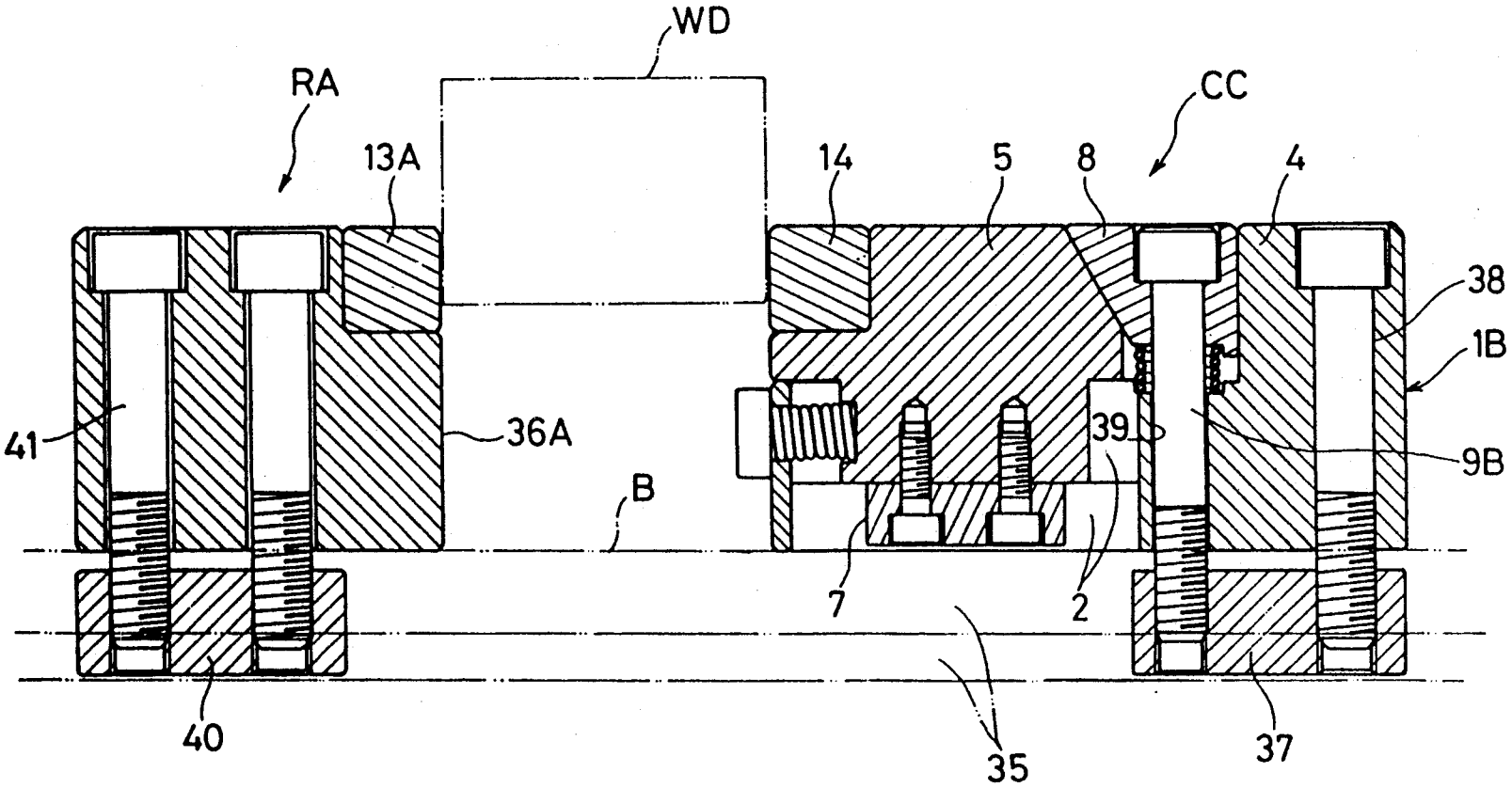
FIG. 25 is a vertically cross sectional view of a clamping device and a reaction supporting device of a sixth embodiment.
Figure 26:
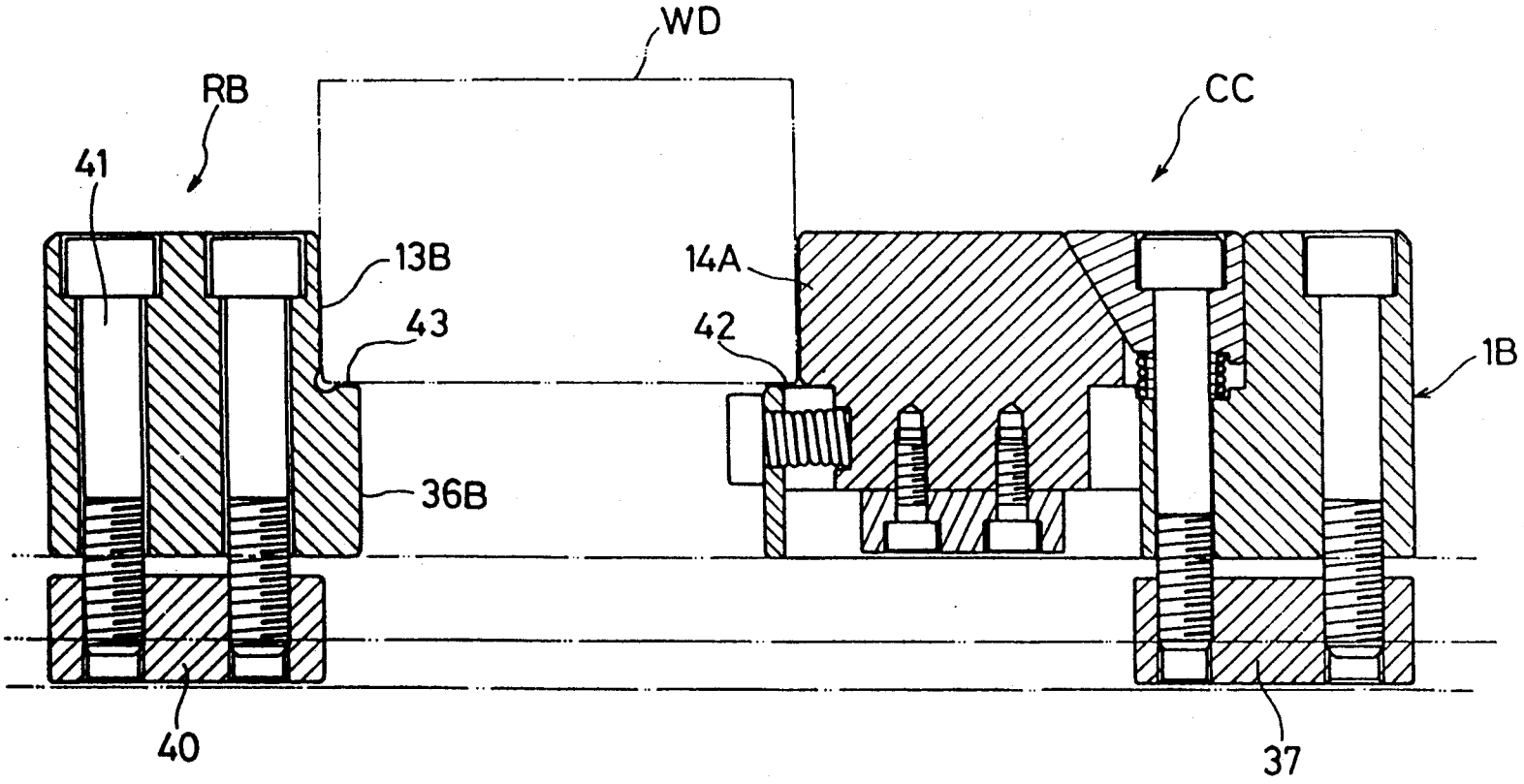
FIG. 26 is a vertically cross sectional view of modifications of the clamping device and reaction receiving device of a fifth embodiment.

Fifth Embodiment See FIGS. 25 to 26.

A clamping device CC of this embodiment is intended to clamp a work piece WD of relatively large size in cooperation with a reaction force receiving device RA. These clamping device CC and reaction force receiving device RA are different from the clamping device CB as well as the reaction force receiving device R in that the clamping device CC and reaction force receiving device RA are designed to be fastened to the base surface B by making use of the T-shaped groove 35. That is, there is provided a leg piece 37 beneath the rear portion of the clamp main body 1B, the leg piece 37 engaging the T-shaped groove 35. The lower end of a single fixing bolt 38 extending through the second reaction force support 4 of the clamp body 1B is threadedly engaged with the leg piece 37, and a clamping bolt 9B penetrating through a bolt hole of the input member 8 and a bolt hole 39 of the clamp body 1B until it reaches the T-shaped groove 35 is engaged at its lower end in threaded engagement with a screw hole of the leg piece 37. The clamping bolt 9B functions to fix the clamp body 1B, and to urge the input member 8 downward.

Similarly in the reaction force receiving device RA, a leg piece 40 is disposed under a block member 36A in the T-shaped groove 35, and two bolts 41 inserted into the bolt hole of the block member 36 are threadedly engaged at its lower end in the screw hole of the leg piece 40, thus the block member 36A is fixed on the base surface B. In the clamping device CC designed to clamp a work piece having a large lateral width, however, the clamp body 1B may have a large width, and the clamping device CC and the reaction force receiving device RA may be fixed on the base surface B through a plurality of the T-shaped grooves 35. In the previous case, the space between the clamping device CC and the reaction force receiving device RA can be so properly changed that work pieces WD of different sizes can be clamped.

A structure as shown in FIG. 26 is also available. FIG. 26 illustrates the configuration of an output portion 14A formed integral with the output member 5 instead of the output portion 14, the output portion 14A having a support 42 at its lower end for supporting the lower rear end portion of the work piece WD. There is provided a reaction force receiving device RB substantially identical to the reaction force receiving device RA, and the reaction output portion 13A is replaced with a reaction output portion 13B formed integral with the body member 36 B and having a support 43 for supporting the front lower end of the work piece WD by the lower end thereof.

Figure 27:
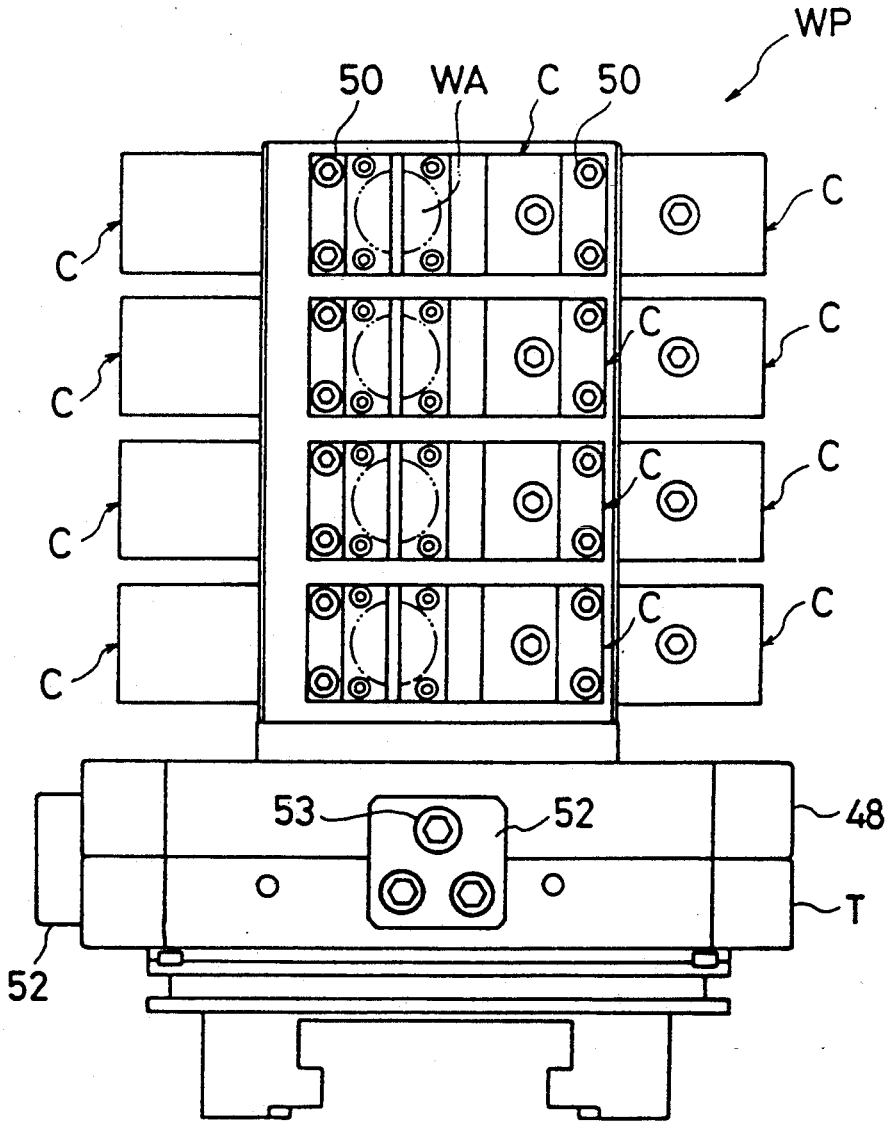
FIG. 27 is a front view of a work piece pallet provided with 16 sets of clamping devices.
Figure 28:
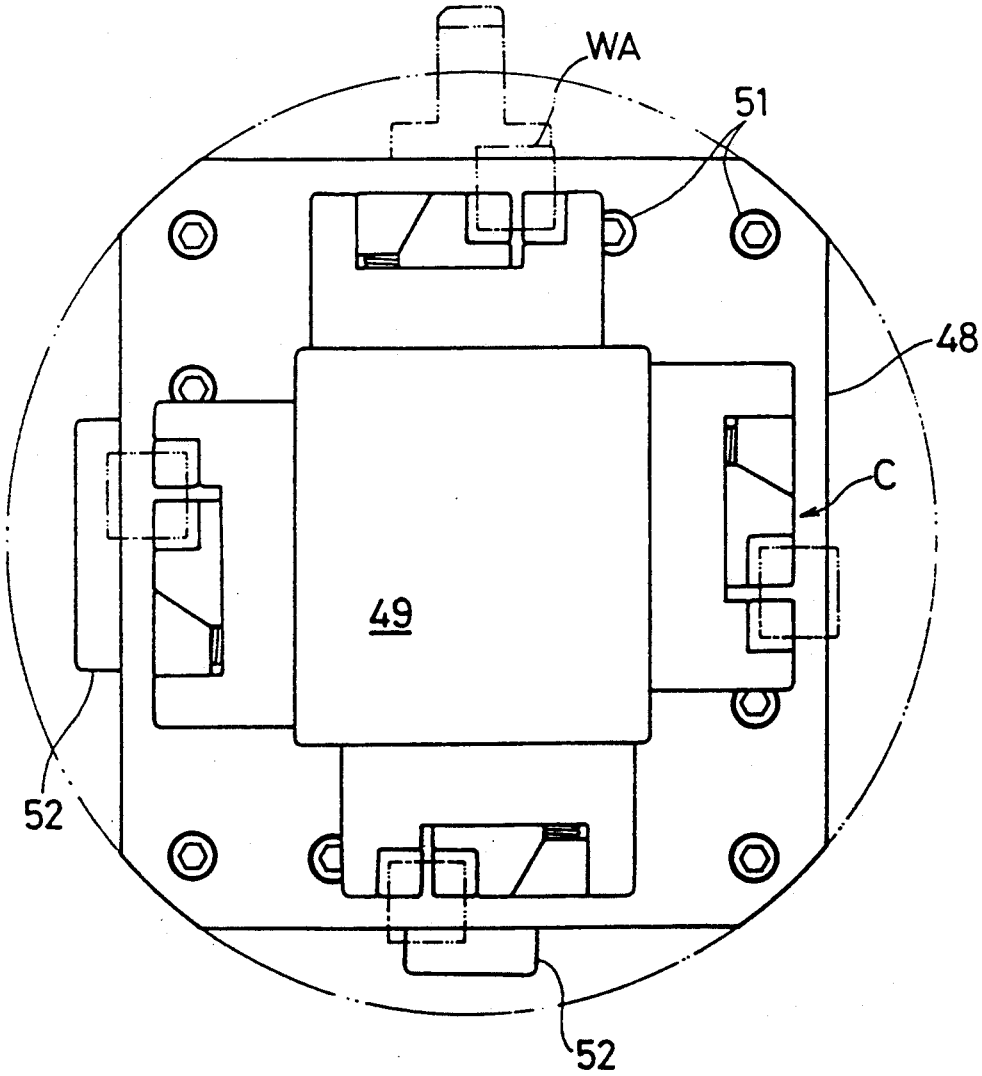
FIG. 28 is a plan view of the work piece pallet of FIG. 27.

Sixth Embodiment See FIGS. 27 and 28.

The present embodiment presents a way of use of the clamping device C in a work piece pallet WP for fixing plural work pieces to be machined by a lateral type machining center. The work pallet WP includes a substantially square flat base member 48 to be locked on a pallet T which will be mounted on the table of the machining center, a square tube-like center member 49 mounted vertically on the center of the top face of the base member 48 and four sets of clamping devices C each being attached to the four sides of the center member 49.

The four clamping devices C on respective sides are laterally spaced with slight intervals between the adjacencys with the sides abutted against the bottom of the clamp body 1, and each of the clamping devices C is fixed by four fixing bolt 50. The clamping device C itself is basically the same as that of the first embodiment; the reaction output portion 13 and output portion 14 are replaced with a reaction output portion 13A and an output portion 14A for clamping a cylindrical work piece WA as shown in FIGS. 9 to 13. The base member 48 is fixed detachably on the pallet T by eight fixing bolts 51. The pallet T has a stopper 52 fixed on the two sides thereof by a bolt 53 for supporting the base member 48 in order to position the base member 48 on the pallet T.

In this work pallet WP, there are provided in total sixteen clamping devices C, namely four clamping devices on each side of the center member 49. This may ensure a highly tight clamping of sixteen work pieces WA. Accordingly, it is very suitable for setting and machining a plurality of relatively small-sized work pieces WA. Alternatively, a clamping device CA provided with the hydraulic cylinder 18 as shown in FIG. 8 could be provided in place of the clamping device C. In that case, it is preferable that oil pressure feeding lines and valves should be installed within the center member 49.

Figure 29:
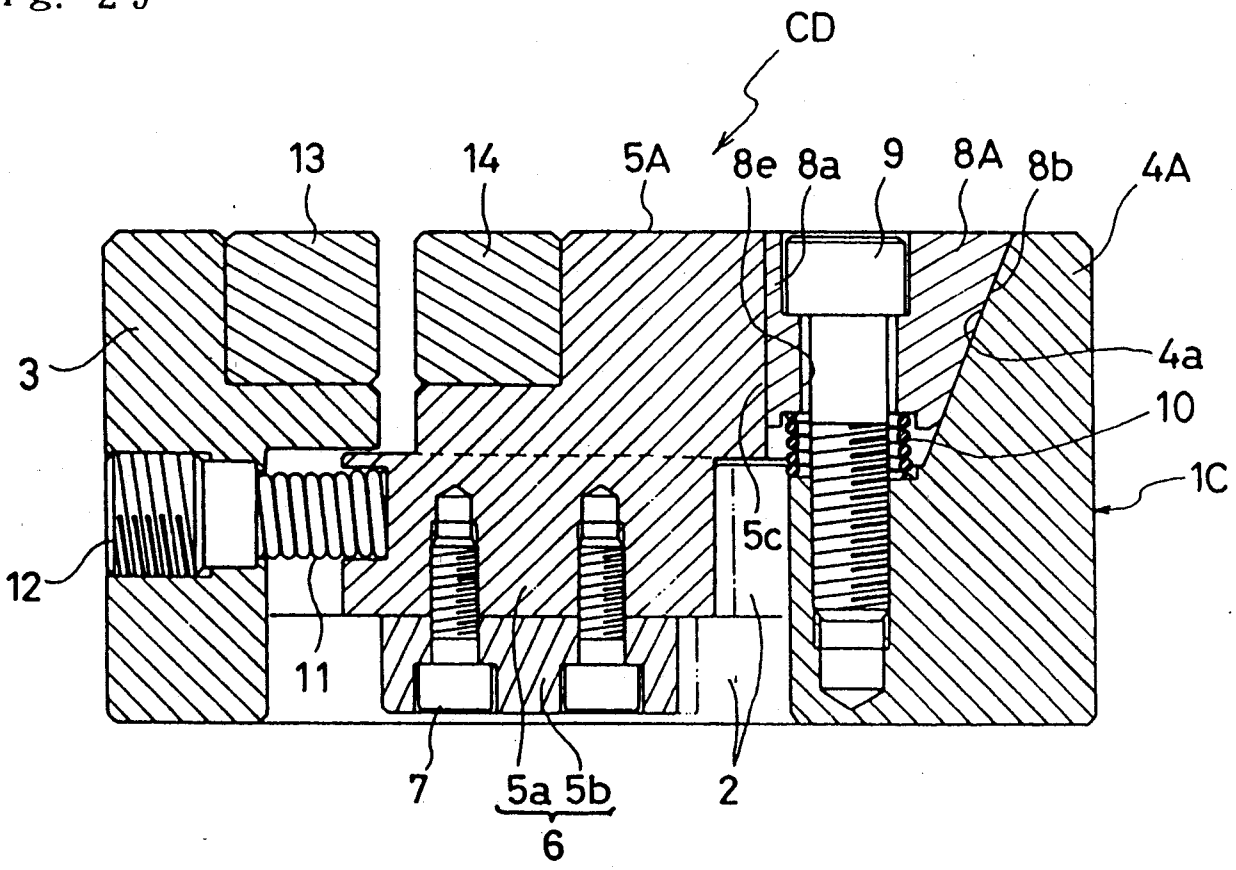
FIG. 29 is a vertically cross sectional view of a clamping device of a seventh embodiment.

Seventh Embodiment See FIG. 29.

In a clamping device CD in accordance with the present embodiment, a wedge type converting mechanism comprises an inclined front end face **4*a* inclined upward toward the rear at about 45 degree and formed on the front end of the second reaction support 4A of the clamp main body 1C, a rear end face 8b abutted altogether against the front end face 4a and formed in the rear end of an input member 8A, an input portion 8a constituting a front end of the input member 8A and formed vertical, and a passive portion 5c formed in the rear end of an output member 5A and abutted altogether against the input portion 8a**.

A bolt hole 8e of the input member 8A is elongating longitudinally to allow the input member 8A to go back and forth. The output member 5A is biased backward by the spring 11, while the input member 8A is biased upward by the spring 10. Therefore, if the bolt 9 is loosened, the input member 8A is moved upward and the output member 5A is moved backward. If the bolt 9 is tightened, the input member 8A is moved in a forward direction by the front end face 4a to urge the output member 5A forward for clamping operation. It is noted that the particular structure of the present embodiment may be applied to the clamping device CB, CC as shown in FIGS. 24 to 26.

Figure 30:
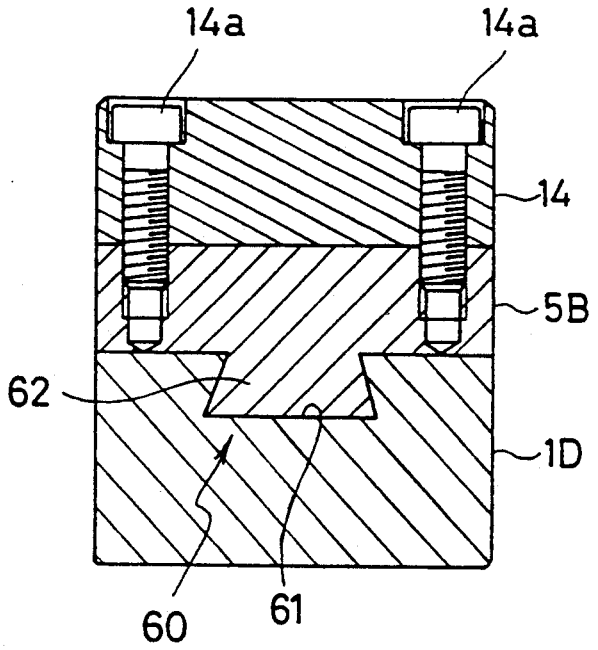
FIG. 30 is a view of a modification of the clamping device of the first embodiment as shown in FIG. 7.

Eighth Embodiment See FIG. 30.

Figure 7:
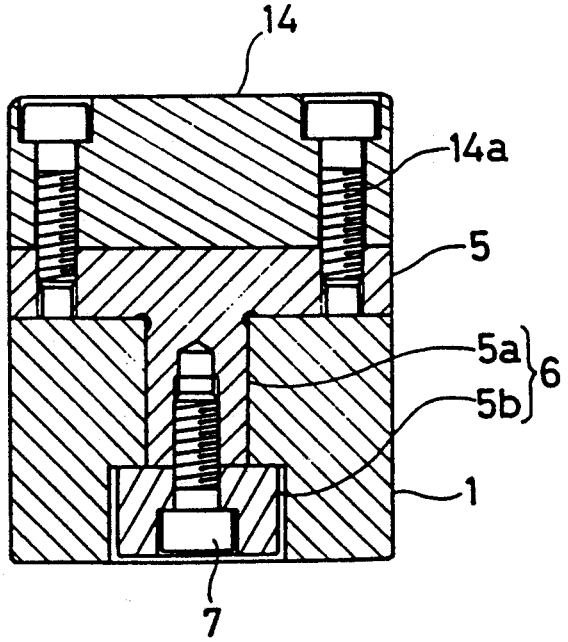
FIG. 7 is a cross sectional view taken along a line 7—7 in FIG. 1.

FIG. 30 is corresponding to FIG. 7, showing a modification of the first embodiment which presents a guide mechanism 60 used in place of the leg 6 of the T-shaped groove 2. A dovetail groove 61 is provided in a clamp main body 1D (or an output member 5B), extending horizontally in a longitudinal direction, and an engaging portion 62 slidably engaged with the dovetail groove 61 is provided in the output member 5B (or the clamp main body 1D). By means of the dovetail groove 61 and engaging portion 62, the output member 5B is guided movable only in a longitudinal direction but not in a vertical direction. As the other structures of this embodiment is the same as those of the first embodiment, similar reference numerals indicate corresponding elements in this figure with a further description thereof being omitted.

Figure 31:
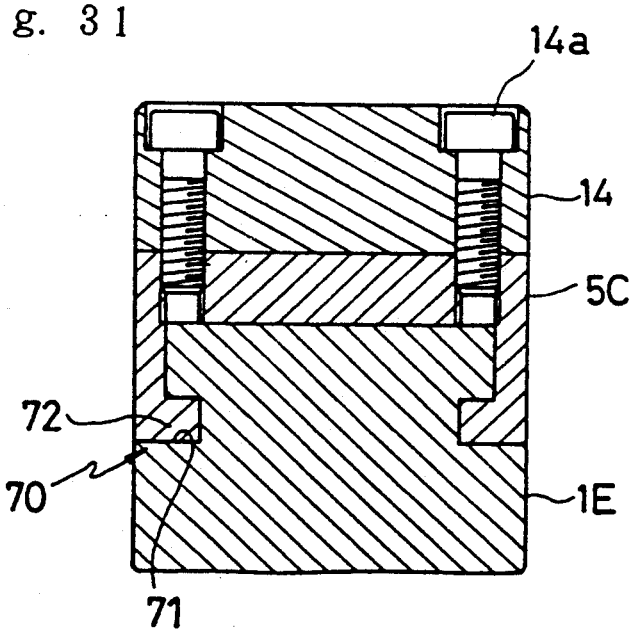
FIG. 31 is a view of a modification of the clamping device of the first embodiment as shown in FIG. 7.

Ninth Embodiment See FIG. 31.

FIG. 31 corresponds to FIG. 7, showing a modification of the first embodiment which represents a guide mechanism 70 used in place of the leg 6 of the T-shaped groove 2. A pair of engaging grooves 71 are provided in a clamp main body 1E (or an output member 5C), extending horizontally in a longitudinal direction, and an engaging groove 72 slidably engaged with the engaging groove 71 is provided in the output member 5C (or the clamp main body 1E). By means of the engaging groove 71 and engaging portion 72, the output member 5C is guided movable only in a longitudinal direction but not in a vertical direction. As the other structures of this embodiment is the same as those of the first embodiment, similar reference numerals indicate corresponding elements in this figure with a further description thereof being omitted.

Figure 32:
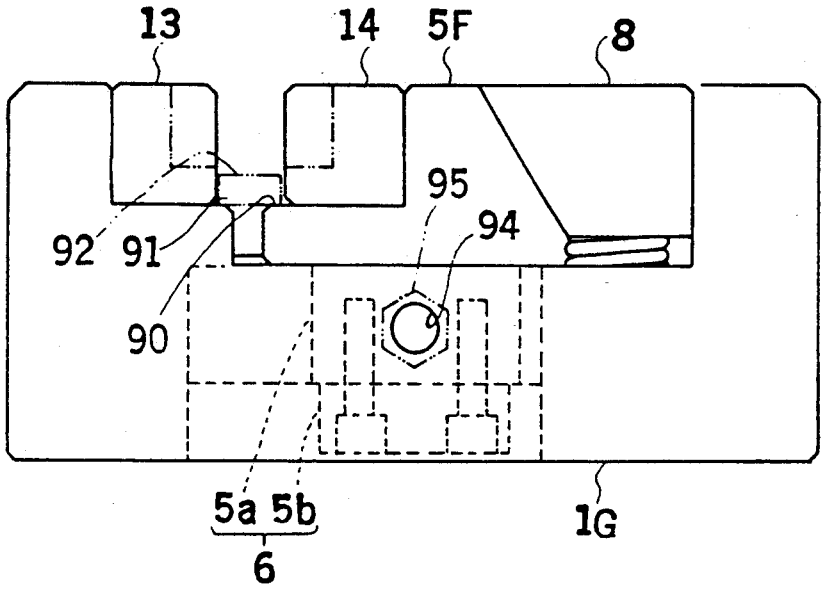
FIG. 32 is a view of a modification of the clamping device of the first embodiment as shown in FIG. 7.

Tenth Embodiment See FIG. 32

FIG. 32 is a view of a modification of the first embodiment as shown in FIG. 7, wherein is shown a guide mechanism 80 provided in place of said T-shaped groove 2 and leg 6.

There are provided on the opposite sides of the clamp main body 1F side walls 81 for guiding the outsides of the input and output members 8 and 5D, and in the middle portions inside the respective side walls 81 are formed guide grooves 82, and engaging members 83 are defined on the opposite sides of the output member 5D to engage in the corresponding guide grooves 82 in such a manner that the engaging members 83 are slidable in forward and backward directions. There is provided at the lower portion of the output member 5D a vertical groove 2a corresponding to the vertical groove portion of said T-shaped groove 2, and a vertical wall 5c is formed on the lower portion of the clamp main body 1F so that the vertical wall 5c can slide in the vertical groove 2a in forward and backward directions, said vertical wall 5c being corresponding to said vertical wall 5a and biased by said compression spring 11 rearwardly. The provision of this particular guide mechanism 80 enables improvement of the function of guiding the output member 5D so that it is movable only in forward and backward directions. However, the guide grooves 82 may be provided in the output member 5D and the engaging members 8 may be provided on the side wall 81. A mechanism intended to fixedly place the clamp main body 1F on the base surface B may comprise flange portions 84 provided extending longitudinally in the opposite sides of the lower end portion of the clamp main body 1F and bolt holes 85 piercing said flange portions 84, into which bolts are to be inserted to secure the clamp main body 1F on the base surface B.

Figure 33:
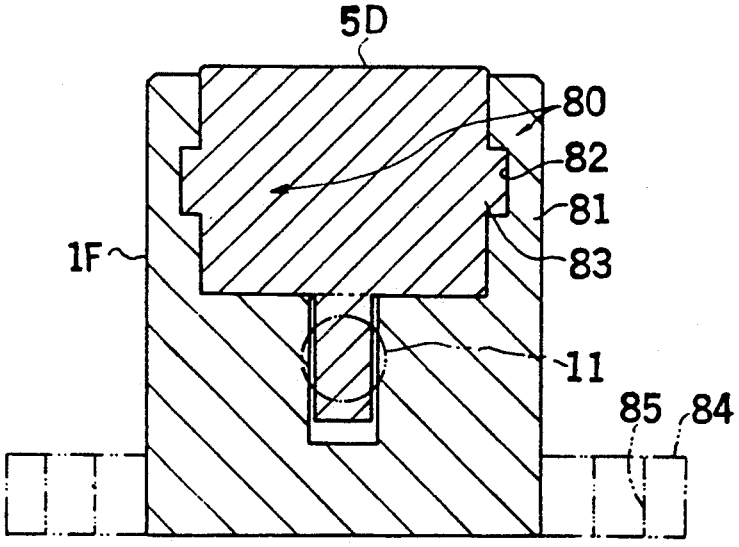
FIG. 33 is a view of a modification of the clamping device of the first embodiment as shown in FIG. 2.
Figure 34:
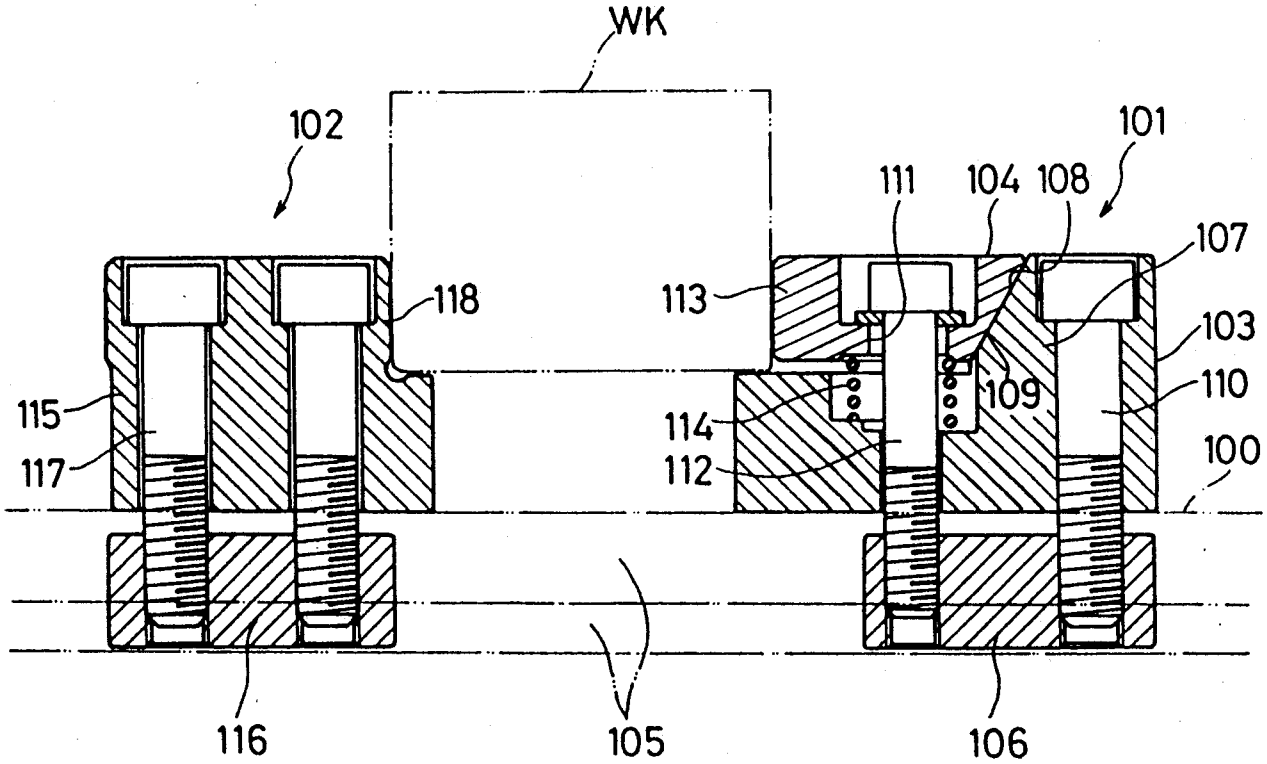
Fig. 34 (Prior Art)
FIG. 34 is a vertically cross sectional view of a clamping device of prior art.

Eleventh Embodiment See FIG. 33

FIG. 33 is a view of a modification of the first embodiment as shown in FIG. 2, and which shows a shelf portion 90 formed on the front end bottom of the output member 5F so as to protrude beyond the front end of the output portion 14, and another shelf portion 91 formed on the reaction support 3 so as to protrude beyond the front end of the reaction output portion 13; a necessary machining should be performed in order to define said work piece holding portions 28 at the same time or different times on the output portion 14 and reaction output portion 13 with the output member 5F being fixed by clamping a provisional member 92 between the output portion 14 and reaction output portion 13. However, rather than use said provisional member 92, the output member 5F may be fastened on a clamp main body 1G by a bolt 95 received by a bolt hole 94 provided extending horizontally and laterally and which bolt hole passes through the clamp main body 1G and the vertical wall 5a of the output member 5F as well. The device as shown in FIG. 32 may also have its output member fixed on the clamp main body.

What is claimed is:

1. A clamping device for clamping a work piece having a shape, comprising:

a clamp main body;

a reaction support provided at a rear part of the clamp main body, an input member arranged on the clamp main body in front of the reaction support with a gap between the input member and the clamp main body and placed in contact with a front end face of the reaction support;

an output member arranged on the clamp main body in front of the input member and having a main portion in contact with a front end of the input member, the output member including at its front end portion an output portion for pressing the work piece forward;

a guide means provided in the clamp main body and the output member, for guiding the output member movably only in a longitudinal direction directed back and forth;

a driving means for driving the input member toward the clamp main body; and a wedge type converting means for converting a driving force supplied to the input member from the driving means into a clamping force for driving the output member forward;

wherein said guide means comprises an inverted T-shaped groove formed in the longitudinal direction in a middle portion of the clamp main body and an inverted T-shaped leg portion of the output member, slidably engaged in the T-shaped groove;

wherein said wedge type converting means comprises an inclined input portion inclined upward toward the front and formed at the front end of the input member, and an inclined passive portion inclined upward toward the front and formed at a rear end of the main portion of the output member and abutting the input portion;

wherein said clamping device includes a spring means interposed between the clamp main body and a front end portion of the inverted T-shaped leg portion to bias the output member toward the reaction support.

2. A clamping device according to claim 1, wherein said wedge type converting means comprises an inclined front end face inclined upward toward the rear and formed at a front end of the reaction support, and an inclined rear end face inclined upward toward the rear and formed at a rear end of the input member and abutting the front end face of the reaction support.

3. A clamping device according to claim 1, wherein said driving means comprises an upright bolt hole formed in the input member, a hydraulic cylinder provided within the clamp main body below the bolt hole, a clamping bolt extending through the bolt hole with its head stopped by the input member and its leg portion secured to a piston rod of the hydraulic cylinder, and a compression coil spring interposed between the input member and the clamp main body and mounted around the clamping bolt.

4. A clamping device according to claim 1, wherein said clamping device includes a reaction support provided at a front end of the clamp main body in opposition to the output portion of the output member, and said reaction support having a reaction output portion for clamping the work piece in cooperation with the output portion of the output member.

5. A clamping device according to claim 1, wherein said guide means includes a dovetail groove formed in the clamp main body in the longitudinal direction and an engaging portion provided at the output member and slidably engaging in the dovetail groove.

6. A clamping device according to claim 1, wherein side walls are provided on the right-and left-hand side portions of said clamp main body, and said guide means comprises guide grooves defined so as to extend in forward and backward directions on the right-hand and left-hand side walls and engaging portions provided in said output member and engaged slidably in said guide grooves.

7. A clamping device according to claim 1, wherein it includes a means adapted for fixing said output member on the clamp main body.

8. A clamping device according to claim 2, wherein said driving means comprises an upright bolt hole formed in the input member, a screw hole formed in the clamp main body below the bolt hole, a clamp bolt extending through the bolt hole with its head stopped by the input member and its leg portion threadedly engaged in the screw hole, and a compression coil spring interposed between the input member and the clamp main body and mounted around the clamp bolt.

9. A clamping device according to claim 2, wherein said driving means comprises an upright bolt hole formed in the input member, a hydraulic cylinder provided within the clamp main body below the bolt hole, a clamping bolt extending through the bolt hole with its head stopped by the input member and its leg portion secured to a piston rod of the hydraulic cylinder, and a compression coil spring interposed between the input member and the clamp main body and mounted around the clamping bolt.

10. A clamping device according to claim 2, wherein said clamping device comprise an inverted T-shaped leg piece to be arranged in a T-shaped groove formed on a base surface on which the clamp main body is to be fixed.

11. A clamping device according to claim 2, wherein said clamping device includes a spring means interposed between the clamp main body and the output member to bias the output member toward the reaction support.

12. A clamping device according to claim 2, wherein said clamping device includes a reaction support provided at a front end of the clamp main body in opposition to the output portion of the output member, and said reaction support having a reaction output portion for clamping the work piece in cooperation with the output portion of the output member.

13. A clamping device according to claim 1, wherein the output portion is detachably fixed to the front end portion of the output member, said output portion being selected according to the shape of the work piece to be clamped.

14. A clamping device according to claim 13, wherein said driving means comprises an upright bolt hole formed in the input member, a screw hole formed in the clamp main body below the bolt hole, a clamp bolt extending through the bolt hole with its head stopped by the input member and its leg portion threadedly engaged in the screw hole, and a compression coil spring interposed between the input member and the clamp main body and mounted around the clamp bolt.

15. A clamping device according to claim 13, wherein said clamping device comprise an inverted T-shaped leg piece to be arranged in a T-shaped groove formed on a base surface on which the clamp main body is to be fixed.

16. A clamping device according to claim 15, wherein said driving means comprises an upright bolt hole formed in the input member, a bolt hole formed in the clamp main body below the bolt hole, a screw hole formed in the leg piece below the bolt hole, a clamping bolt extending through said two bolt holes with its head stopped by the input member and its leg portion threadedly engaged in the screw hole, and a compression coil spring interposed between the input member and the clamp main body and mounted around the clamp bolt.

* * * * *